United States Patent [19]

Dickinson, III et al.

[11] Patent Number: 4,790,394

[45] Date of Patent: Dec. 13, 1988

[54] HYDRAULIC DRILLING APPARATUS AND METHOD

[75] Inventors: Ben W. O. Dickinson, III, 2125 Broderick St., San Francisco, Calif. 94115; Robert W. Dickinson, 40 Maplewood Dr., San Rafael, Calif. 94901; Richard R. Jensen, Hacienda Heights, Calif.; Sherman C. May, San Francisco, Calif.; Charles S. Mackey, Bakersfield, Calif.; Robert D. Wilkes, Jr., Berkeley, Calif.

[73] Assignees: Ben Wade Oakes Dickinson, III; Robert Wayne Dickinson, both of San Francisco, Calif.

[21] Appl. No.: 932,711

[22] Filed: Nov. 19, 1986

Related U.S. Application Data

[63] Continuation-in-part of Ser. No. 853,548, Apr. 18, 1986, abandoned.

[51] Int. Cl.[4] ..... E21B 7/18

[52] U.S. Cl. ..... 175/61; 175/67; 175/73; 175/340

[58] Field of Search ..... 175/61, 65, 67, 73, 175/100, 107, 317, 393, 424, 339, 340; 299/14; 166/222, 223

[56] References Cited

U.S. PATENT DOCUMENTS

| | | | |
|---|---|---|---|
| 2,167,194 | 7/1939 | Anderson | 175/61 X |
| 2,169,718 | 8/1939 | Boll et al. | 175/217 X |
| 2,710,170 | 6/1955 | Livingston et al. | 175/61 X |
| 2,873,092 | 2/1959 | Dwyer | 175/61 |
| 3,111,171 | 11/1963 | Ferrar et al. | 166/222 X |
| 4,342,425 | 8/1982 | Vickers | 175/67 X |
| 4,474,251 | 10/1984 | Johnson, Jr. | 175/67 |
| 4,497,664 | 2/1985 | Verry | 175/67 X |
| 4,512,420 | 4/1985 | Hayatdavoudi et al. | 175/67 |
| 4,619,335 | 10/1986 | McCullough | 175/340 X |

FOREIGN PATENT DOCUMENTS

| | | | |
|---|---|---|---|
| 281318 | 1/1971 | U.S.S.R. | 175/339 |

*Primary Examiner*—Stephen J. Novosad
*Assistant Examiner*—William P. Neuder
*Attorney, Agent, or Firm*—Flehr, Hohbach, Test, Albritton & Herbert

[57] ABSTRACT

Hydraulic drilling apparatus and method suitable for use in a variety of applications including the drilling of deep holes for oil and gas wells and the drilling of vertical, horizontal or slanted holes, drilling through both consolidated and unconsolidated formations, and cutting and removing core samples. The drill head produces a whirling mass of pressurized cutting fluid, and this whirling fluid is applied to a discharge nozzle to produce a high velocity cutting jet. The cutting action is enhanced by abrasive material in the drilling fluid. The direction of the borehole is controlled by controlling the discharge of the drilling fluid either in side jets directed radially from the distal end portion of the drill string which carries the drill head or in a plurality of forwardly directed cutting jets.

60 Claims, 7 Drawing Sheets

HYDRAULIC DRILLING APPARATUS AND METHOD

This is a continuation-in-part of Ser. No. 853,548, filed Apr. 18, 1986, now abandoned, in the names of Ben Wade Oakes Dickinson III, Robert Wayne Dickinson, Richard R. Jensen, Sherman C. May and Charles S. Mackey.

This invention pertains generally to the drilling of boreholes in the earth, and more particularly to hydraulic drilling apparatus in which cutting is effected by streams of fluid directed against the material to be cut.

For many years, oil and gas wells have been drilled by a rotary bit mounted on a tubular drill string which extends down the borehole from the surface of the earth. The drill string is rotated at the surface, and the rotary motion is transmitted by the string to the bit at the bottom of the hole. A liquid commonly known as drilling mud is introduced through the drill string to carry cuttings produced by the bit to the surface through the annular space between the drill string and the wall of the borehole. This method of drilling has certain limitations and disadvantages. The string must be relatively heavy in order to transmit torque to the bit at the bottom of the hole. In hard rock, the drilling rate is slow, and the bit tends to wear rapidly. When the bit must be replaced or changed, the entire string must be pulled out of the hole and broken down into tubing joints as it is removed. It is necessary to use heavy, powerful machinery to handle the relatively heavy drill string. The string is relatively inflexible and difficult to negotiate around bends, and frictional contact between the string and the well casing or bore can produce wear as well as interfering with the rotation of the drill bit. Powerful equipment is also required in order to inject the drilling mud with sufficient pressure to remove cuttings from the bottom of the well.

More recently, wells and other boreholes have been drilled with small, high velocity streams or jets of fluid directed against the material to be cut. Examples of this technique are found in U.S. Pat. Nos. 4,431,069, 4,497,381, 4,501,337 and 4,527,639. In U.S. Pat. Nos. 4,431,069 and 4,501,337, the cutting jets are discharged from the distal end of a hollow pipe positioned within an eversible tube having a rollover area which is driven forward by pressurized fluid. U.S. Pat. Nos. 4,497,381 and 4,527,639 disclose hydraulic jet drill heads attached to drilling tubes which are driven forward by hydraulic pressure, with means for bending the tube to change the direction of drilling, e.g. from horizontal to vertical.

With hydraulic drill heads heretofore provided, it is difficult to cut holes large enough to pass a drill string in certain materials. The larger diameter is important because the string must pass freely through the borehole for the system to operate properly. To produce a reasonably round and straight hole, the drill must cut in a symmetrical manner. With the drill heads heretofore provided, only oblique jets will provide the desired cutting pattern. However, obliquely inclined jets tend to cut radial slots or grooves, rather than smooth round holes, and this problem increases as the oblique angle increases. In softer materials and unconsolidated formations, a non-rotating hydraulic drill head with axially directed jets may be able to cut holes several times the diameter of the drill head or spacing between the jets.

However, in more indurated materials and consolidated formations, the holes cut by this type of drill head may not be much larger than the individual nozzles in the drill head itself.

To produce larger holes, rotating drill heads with obliquely inclined jets have been provided. These jets may cut concentric grooves or slots and can produce holes larger than the drill head even in harder formations. Examples of such drill heads are found in U.S. Pat. Nos. 2,678,203, 3,055,442, 3,576,222, 4,031,971, 4,175,626 and 4,529,046. In most of these systems and in some nonrotating drill heads, abrasive particles are entrained in the cutting jets to improve the cutting action. U.S. Pat. No. 4,534,427 discloses a drill head which uses a combination of hydraulic jets and hard cutting edges to cut grooves and remove material between the grooves. While rotating drill heads are capable of cutting larger holes than non-rotating drill heads in certain materials, the useful life of rotating drill heads is severely limited by bearing wear, particularly when abrasive materials are present as in most drilling operations.

U.S. Pat. Nos. 3,528,704 and 3,713,699 disclose drill heads which employ cavitation of the drilling fluid in order to increase the erosive effect of the cutting jets. These drill heads appear to have the same limitations and disadvantages as other non-rotating drill heads as far as hole size is concerned, and they are unstable with respect to back pressure and affected by depth of application.

It is in general an object of the invention to provide a new and improved hydraulic drilling apparatus and method for forming boreholes in the earth.

Another object of the invention is to provide a hydraulic drilling apparatus and method of the above character which overcome the limitations and disadvantages of hydraulic drilling techniques of the prior art.

Another object of the invention is to provide a hydraulic drilling apparatus and method of the above character which can be employed for drilling deep holes for oil and gas wells, for drilling horizontal, vertical or slanted holes in all earth materials, and for drilling in both consolidated and unconsolidated formations.

Another object of the invention is to provide a hydraulic drilling apparatus and method of the above character which can produce generally round holes larger than the nozzles in the drill head even in consolidated formations.

Another object of the invention is to provide a hydraulic drilling apparatus and method of the above character in which the direction of the borehole is automatically controlled.

Another object of the invention is to provide a hydraulic drilling apparatus and method of the above character in which the drill head can be replaced or changed without removing the drill string from the borehole.

Another object of the invention is to provide a hydraulic drilling apparatus and method of the above character which can be utilized to obtain core samples from the earth.

Another object of the invention is to provide a hydraulic drilling apparatus and method of the above character in which the drill head is economical to manufacture.

These and other objects are achieved in accordance with the invention by producing a whirling mass of pressurized fluid within the drill head. The whirling fluid is introduced into a discharge nozzle in such manner that the fluid spins helically within the nozzle and emerges therefrom as a high velocity cutting jet. In some embodiments, the fluid is discharged from a central nozzle as a thin wall conical cutting jet, and in one of these embodiments a plurality of axially directed jets are spaced about the central nozzle for removing material within the circular groove or annulus cut by the conical jet. In another embodiment, the discharge nozzle comprises an oblique bore in a rotor which is driven at a relatively slow speed (e.g. 5–50 rpm) by the whirling fluid in the drill head. In some embodiments, the cutting action is enhanced by an abrasive material in the drilling fluid.

The direction of the borehole is controlled by controlling the discharge of the drilling fluid either in side jets directed radially from the distal end portion of the drill string which carries the drill head or in a plurality of forwardly facing cutting jets aimed ahead of the drill string so as to modify the geometry of the hole being cut.

In one embodiment, the drill head is mounted on a carrier which can be withdrawn from the drill string and replaced while the drill string remains in the hole.

Figure 1:
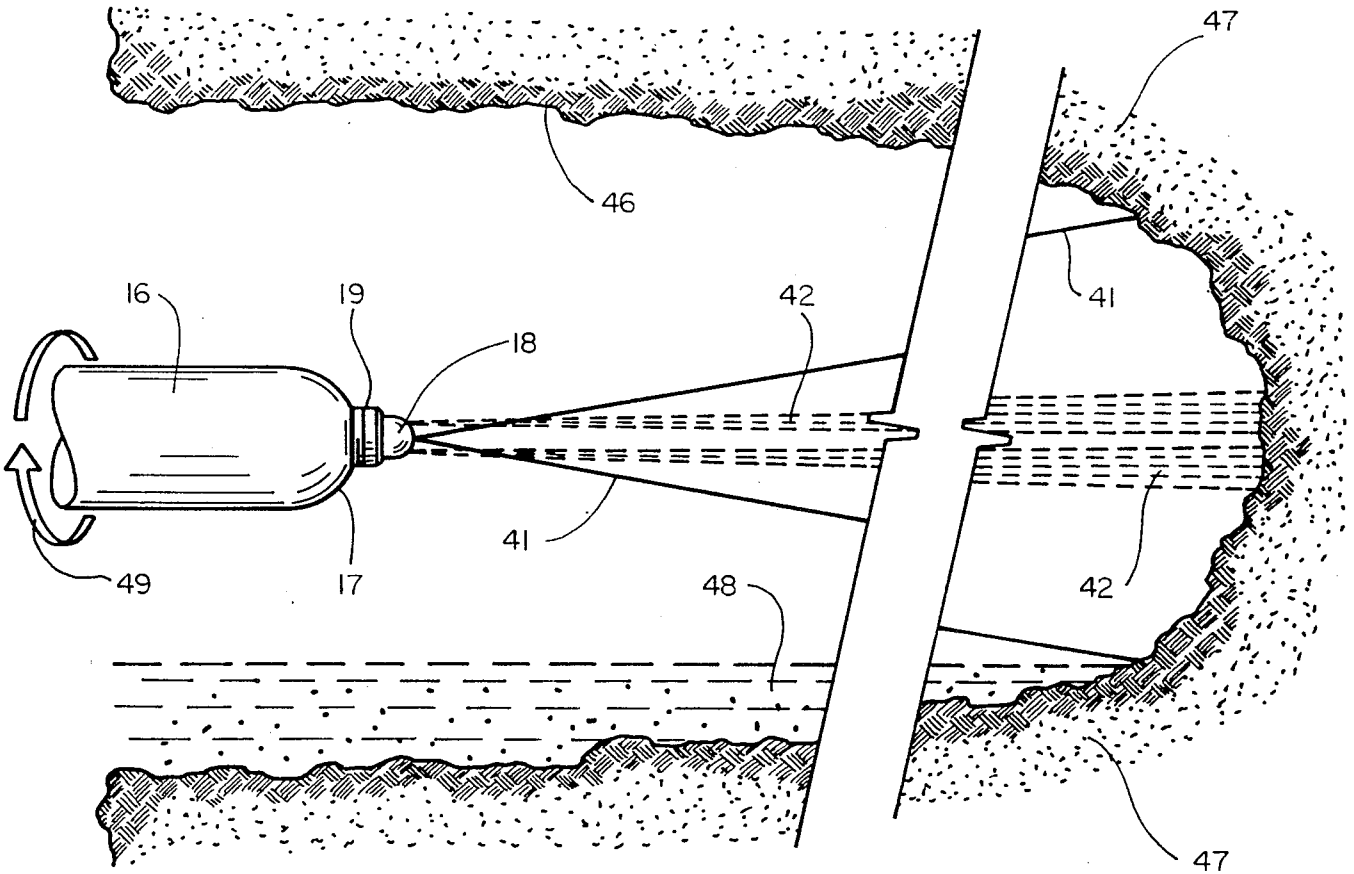
FIG. 1 is a fragmentary side elevational view of one embodiment of drilling apparatus according to the invention cutting a borehole in a subterranean formation.
Figure 2:
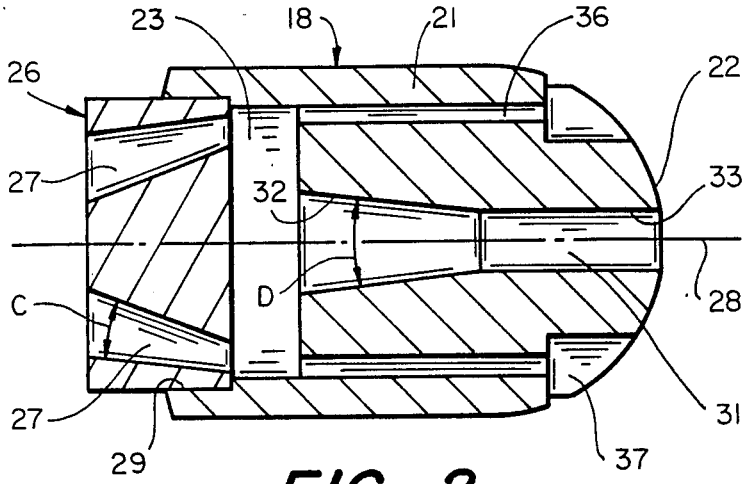
FIG. 2 is a centerline sectional view of the drill head in the embodiment of FIG. 1.
Figure 3:
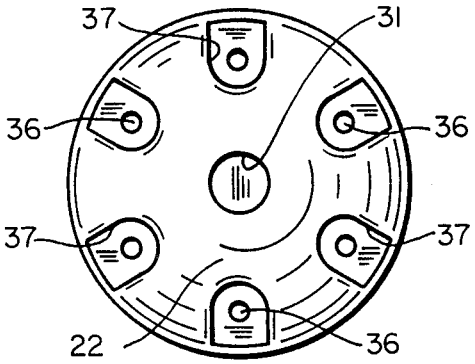
FIG. 3 is a front view of the drill head of FIG. 2.

As illustrated in FIG. 1, the drilling apparatus comprises a tubular drill string 16 having a rounded nose or distal end 17. A hydraulic drill head 18 is mounted in a bushing 19 which, in this particular embodiment, is threadedly connected to the distal end of the drill string. It will be understood, however, that the drill head can be connected to the string by other suitable means such as welding.

As illustrated in FIGS. 2–5, drill head 18 comprises a generally cylindrical body 21 having a rounded nose 22. A plenum chamber 23 of circular cross-section is positioned coaxially within body 21. This chamber is of relatively short length in the embodiment illustrated, and in this example the diameter of the chamber is approximately four times the length of the chamber. The drill head body is fabricated of a rigid material such as steel, and it is affixed to bushing 19 by a suitable means such as brazing or welding.

Figure 4:
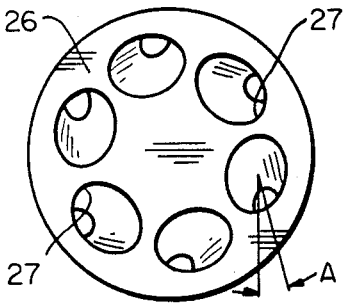
FIG. 4 is a rear view of the nozzle block in the drill head of FIG. 2.
Figure 5:
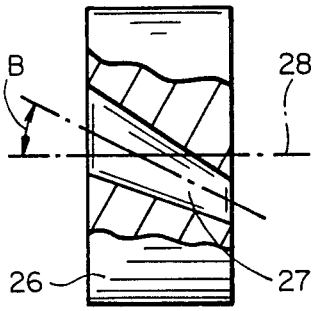
FIG. 5 is a fragmentary side view of the nozzle block in the drill head of FIG. 2.

Means is provided for producing a whirling mass of pressurized fluid in plenum chamber 23. This means comprises a nozzle block 26 in which a plurality of stationary inlet nozzles 27 are formed. Nozzles 27 are spaced circumferentially about the axis 28 of the drill head, and they are conically tapered and inclined obliquely relative to this axis. The rotational velocity of the pressurized fluid in chamber 23 is to a large extent dependent upon the angle of inclination. In one presently preferred embodiment, each of the inlet nozzles is inclined at an angle A of 7° in a radial direction and an angle B of 26° in a tangential direction, as illustrated in FIGS. 4 and 5. In this embodiment, the tapered nozzles have an included angle C of 14°. Other inclinations and tapers can be employed, depending upon the properties desired in the fluid. Angle A can be between about 5° and about 25°, angle B can be between about 2° and about 45°, and angle C can be between about 10° and about 20°. The nozzle block is fabricated of a rigid material such as steel or aluminum, and it is pressed into a counterbore 29 at the rear of body 21.

A central discharge nozzle 31 is formed in the drill head body at the end of plenum chamber 23 opposite nozzle block 26. The discharge nozzle has a conically tapered bore 32 at its proximal end and a cylindrical bore 33 at its distal end. In the embodiment illustrated, the two sections of the bore are approximately equal in length, and the tapered section has an included angle D of 13°. Other suitable bore lengths and tapers can be employed, if desired. Angle D is preferably on the order of 10°–20°. In the embodiment illustrated, discharge nozzle 31 is of greater diameter than inlet nozzles 27, and the inlet diameter of tapered bore section 32 is slightly less than half the diameter of plenum chamber 23 and twice the diameter of bore section 33.

A plurality of axially directed nozzles 36 are spaced circumferentially about central nozzle 31. Each of these nozzles has a straight cylindrical bore of substantially smaller diameter than central nozzle 31. Relief pockets 37 are formed in the nose of body 21 at the distal ends of bores 36. In the embodiment illustrated, the drill head has six inlet nozzles 27 and six peripheral nozzles 36 spaced equally about axis 28. It will be understood, however, that any suitable number of nozzles can be employed and that the number of inlet nozzles does not have to be the same as the number of outlet nozzles.

Operation and use of the embodiment of FIGS. 1–5, and therein the method of the invention are as follows. Pressurized fluid from drill string 16 enters nozzles 27 and is discharged therefrom as a whirling mass of pressurized fluid in plenum chamber 23. The whirling fluid enters discharge nozzle 31 and spins helically as it passes through this nozzle. The fluid emerges from nozzle 31 as a thin wall conical jet 41, as illustrated in FIG. 1. The particles of fluid leaving the nozzle travel along linear paths which are oblique to the axis of the drill head. The angle of the conical jet is determined by the dimensions of the nozzle and the rotational velocity of the fluid in chamber 23. The rotational velocity is dependent upon the pressure of the fluid and the inclination of the inlet jets. For a given pressure, the rotational velocity and the angle of the cutting cone increase as the angle of inclination of the inlet jets is increased. The axially directed jets 42 produced by peripheral nozzles 36 pass through conical shell 41 and strike the material in front of the drill head within the region bounded by the conical shell.

The embodiment of FIGS. 1–5 has been found to be surprisingly effective in cutting both consolidated formations and unconsolidated formations. FIG. 1 illustrates the use of this embodiment in cutting a horizontal borehole 46 in an unconsolidated formation 47. In this particular example, water at a pressure on the order of 8,000–10,000 psi is introduced into the drill string at the top of the borehole as the drilling fluid. There is a pressure drop within the drill string and across the inlet nozzles. The drop across the nozzles is about 2,000 psi, and the pressure in chamber 23 is on the order of 6,000–8,000 psi. The wall of the conical cutting jet is calculated to be on the order of 0.005–0.015 inch thick at a distance of 6–12 inches from the drill head, depending upon the axial and tangential velocities of the water particles. FIG. 1 shows the conical jet and the peripheral jets cutting into the unconsolidated formation about 48 inches ahead of the drill head and forming a relatively smooth, round hole having a diameter on the order of about 18 inches.

It is believed that the individual water particles in the conical cutting jet move in straight paths as they travel toward the formation and that cuttings dislodged from the formation by the conical jet become entrained in the jet and impact upon the formation to further enhance the cutting process. The slurry thus formed is believed to form a whirling reentrant torus in the area where the cutting occurs. By utilizing the cuttings in this manner, the need for a separate supply of abrasive particles is eliminated. A slurry 48 of the drilling fluid and cuttings collects at the lower side of the hole.

If desired, drill string 16 can be rotated about its axis, as indicated by arrow 49, to reduce friction as the string is fed into the borehole. Such rotation is not necessary for the cutting process in view of the symmetrical cutting action of the cutting jet.

In consolidated formations and in harder, more indurated materials, there is a significant improvement in cutting rates over hydraulic drills heretofore provided. In highly indurated materials such as granite cobbles and small boulders having a compressive strength of 16,000 psi and a tensile strength of 6,000 psi, cutting rates of about 1 inch per minute have been obtained with the drill head of FIGS. 1–5. Even greater cutting rates are obtained with other drill heads disclosed hereinafter and by adding an abrasive material to the drilling fluid. In harder materials, the borehole is somewhat smaller than in softer materials, but it is still large enough to pass the drill string freely. In the embodiment of FIG. 1, for example, the drill head has a diameter on the order of 1.25 inch, and the string has a diameter on the order of 4.5 inches.

It is significant that the drill will cut consolidated formations having a greater compressive strength than the water pressure employed in the drill. In the example given above, rock having a compressive strength of 16,000 psi was cut with a water pressure of only 6,000–8,000 psi at the drill head. The ability to cut harder materials in this manner is somewhat surprising, and it is believed to be due to the turbulence of the water particles and the abrasive action of the entrained cuttings, as discussed above.

The drill head of FIGS. 1–5 can also be utilized for cutting core samples. In this application, the peripheral cutting jets are not employed, and the core sample is cut by the conical cutting jet.

Figure 6:
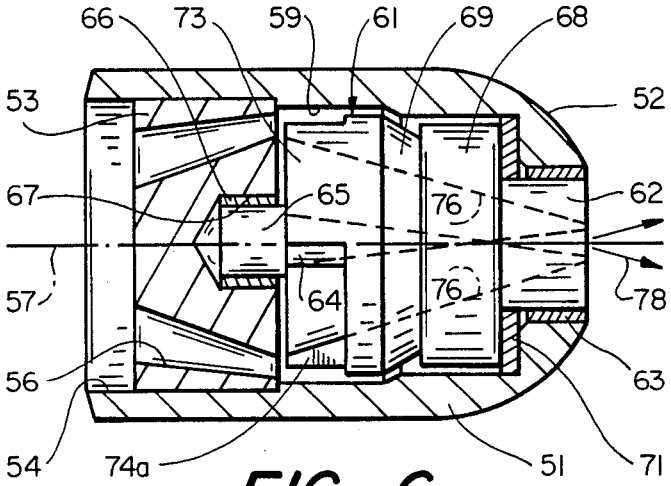
FIG. 6 is a centerline sectional view of another embodiment of a drill head according to the invention.
Figure 7:
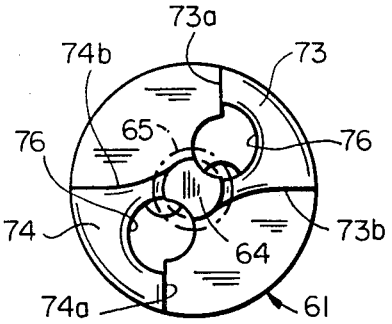
FIG. 7 is a rear view of the rotor in the drill head of FIG. 6.

The drill head illustrated in FIGS. 6 and 7 also has a cylindrical body 51 with a rounded distal end or nose 52. A nozzle block 53 similar to nozzle block 26 is mounted in a counterbore 54 toward the rear of body 51. This block has obliquely inclined nozzles 56 spaced about the axis 57 of the drill head.

An internal chamber 59 is formed in body 51, and a rotor 61 is mounted in this chamber for rotation about the axis of the drill head. The rotor has a front shaft 62 journalled for rotation in a bearing 63 at the front of body 51 and a rear shaft 64 with a bushing 65 journalled for rotation in a bearing 66 mounted in an axial bore 67 in nozzle block 53. A bushing 68 is pressed onto a conical surface 69 on the front side of the rotor body, and the front surface of this bushing bears against a thrust washer 71.

Rotor 61 has a pair of generally sector shaped vanes 73, 74 which interact with the whirling fluid in chamber 59 to turn the rotor about its axis. Each of these vanes has a pair of oppositely facing surfaces **73*a*, 73*b* and 74*a*, 74*b* on which the fluid acts. Fluid impinging upon surfaces 73*a*, 74*a* tends to turn the rotor in a clockwise direction, as viewed in FIG. 7, and fluid impinging upon surfaces 73*b*, 74*b* resists this rotation. Thus, in effect, surfaces 73*b*, 74*b*** function as a brake which limits the speed at which the rotor turns. To minimize bearing wear and thereby increase the operating life of the drill head, the rotor speed is preferably limited to a speed on the order of 5–50 rpm.

Rotor bores 76 serve as discharge nozzles in this embodiment. These bores are conically tapered and inclined obliquely relative to the axis of the rotor. In one presently preferred embodiment, bores 76 have an included angle of 14°, and they are inclined at an angle of 12° relative to the axis of the rotor. As best seen in FIG. 7, the inclined bores cut into the sides of rotor shaft 64, and bushing 65 is fitted over this portion of the shaft to provide a smooth journal surface for bearing 66.

Operation and use of the embodiment of FIGS. 6–7, and therein the method of the invention are as follows. The drill head is mounted on the distal end or nose of the drill string in a manner similar to drill head 18. When pressurized drilling fluid is applied to inlet nozzles 56, they produce a whirling mass of pressurized fluid in plenum chamber 59. The fluid impinging upon the surfaces of vanes 73, 74 cause the rotor to turn at a relatively low speed (5–50 rpm).

The pressurized fluid also enters rotor bores 76 and is discharged from these bores as high velocity cutting jets 78. These jets are directed at an angle corresponding to the inclination of the rotor bores and they cut a circular bore hole as the rotor turns. This drill performs well in both consolidated and unconsolidated formations. The slow rate of rotation gives substantially longer bearing life than other rotating hydraulic drills which turn at higher speeds. As in the embodiment of FIGS. 1–5, rotation of the drill string is not necessary for proper cutting action with this drill head, although drill string rotation is desirable from the standpoint of reducing friction as the string is advanced.

Figure 8:
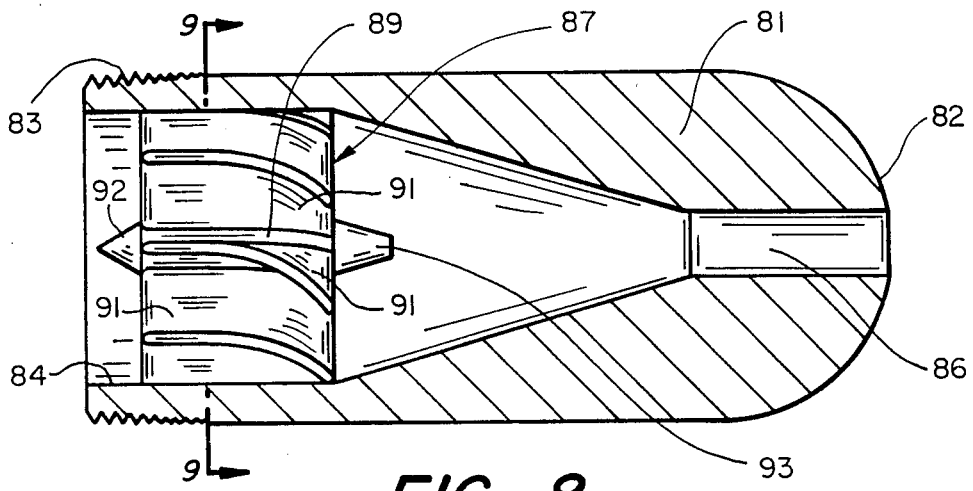
FIG. 8 is a centerline sectional view of another embodiment of a drill head according to the invention.
Figure 9:
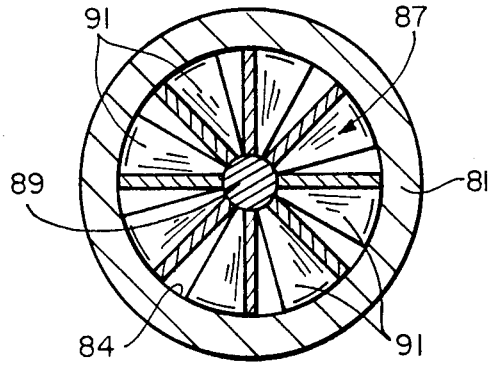
FIG. 9 is a cross-sectional view taken along line 9—9 in FIG. 8.

In the embodiment of FIGS. 8–9, the drill head comprises a generally cylindrical body 81 which has a rounded nose 82. A male pipe thread 83 is formed toward the rear of the body for connecting the drill head to the drill string. As in the other embodiments, the drill head can be connected to the string by any suitable means. An axial bore or chamber 84 is formed toward the rear of the body, and a discharge nozzle similar to nozzle 31 is formed toward the front of the body.

A stationary flow director 87 is mounted in chamber 84 for imparting a circular motion or angular velocity to pressurized fluid supplied to the inlet side of the chamber to produce a whirling mass of pressurized fluid at the discharge side of the chamber. The whirling fluid passes through discharge nozzle 86 and emerges as a high velocity, thin wall conical jet, as in the embodiment of FIGS. 2–5.

Flow director 87 has a central core 89 positioned coaxially within chamber 84, with a plurality of radial vanes 91 extending longitudinally of the chamber. The vanes are spaced symmetrically about the axis of the chamber, and in the embodiment of FIGS. 8–9, eight such vanes are provided. A greater or lesser number of vanes can be employed, if desired.

The end portions of the vanes 91 toward the inlet side of chamber 84 are generally straight and parallel to the flow of fluid supplied to the chamber in an axial direction. Toward the discharge side of the chamber, the vanes are curved, and the exit portions of the vanes are oblique to the axis of the chamber. Although the exit portions are obliquely aligned with respect to the inlet flow, these portions of the vanes are preferably not curved, the curvature occurring between the relatively straight inlet and exit portions. In one presently preferred embodiment, the chamber has a diameter on the order of 1 inch, and each of the vanes has an overall length on the order of 0.750 inch, with the first 0.250 inch of the vane being straight and the remainder being formed with a radius of curvature of 0.550 inch. The leading and trailing edges of the vanes are tapered.

Axially extending cones 92, 93 are provided at the inlet and discharge ends of deflector 87. The bases of these cones are approximately equal in diameter to core 89, and these cones help to guide the pressurized fluid into and out of the deflector vanes. The length and angle of inlet cone 92 do not appear to be critical, but best results have been achieved when discharge cone 93 is truncated and has an included angle corresponding to the inlet angle of discharge nozzle 86.

The angle of the cone of drilling fluid produced by the embodiment of FIGS. 8–9 is determined primarily by the exit angle of the vanes, i.e. the angle between a plane tangent to the curved surface of one of the vanes at its discharge end and a plane parallel to the axis of the nozzle. The angle of the cone increases as the exit angle increases. The angle of the cone is also believed to be at least somewhat dependent upon the axial position of the deflector 87 relative to discharge nozzle 86, with the angle of the cone decreasing as the vanes are moved away from the nozzle.

The embodiment of FIGS. 8–9 has been found to have approximately twice the cutting power of the embodiment of FIGS. 2–5 for a given pressure of drilling fluid. The pressure drop across the vanes is substantially less than the drop across the nozzle block in the earlier embodiment, and the same amount of cutting can be done with a lower applied pressure.

A further improvement in the cutting action with the embodiment of FIGS. 8–9 can be achieved by introducing an abrasive material such as sand, silica flour or particles or dirt into the cutting fluid which is supplied to the drill head. The abrasive increases the cutting power of the jet produced by this head by about tenfold. Thus, with the abrasive, the head of FIGS. 8–9 provides about 20 times the cutting power and penetration rate of the head of FIGS. 2–5. Compared with the other embodiments, this substantial and unexpected increase in cutting power and rate of penetration provides the same amount of cutting with a substantially lower applied pressure or much faster cutting with a given pressure.

Figure 10:
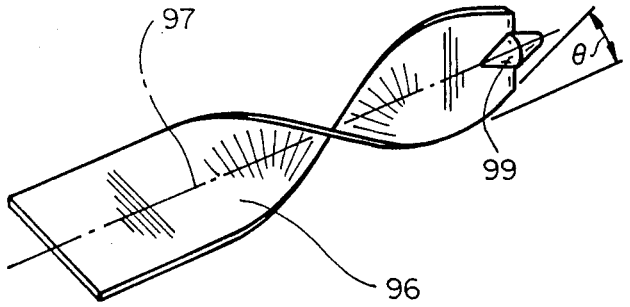
FIG. 10 is a perspective view of one embodiment of a flow directing vane for use in a drill head according to the invention.

FIG. 10 illustrates another embodiment of a flow director which can be employed in a drilling head of the type illustrated in FIG. 8. This director comprises a single axially extending vane 96 which is twisted about its axis 97 and mounted coaxially within the drill head chamber to impart the desired whirling motion or angular velocity to the pressurized fluid. This deflector has a discharge cone 99 similar to cone 93. The inlet end portion of vane 96 is generally planar and parallel to the axial flow of the pressurized fluid supplied to the drilling head. The leading and trailing edges of the vane can be tapered, if desired, and in one presently preferred embodiment, the rate of curvature or twist increases sinusoidally to an exit angle $\alpha$ of about 45° at the distal end of the vane so that the vane is twisted more tightly toward the distal end of the chamber. The cutting jet produced by a drill head employing the twisted vane deflector is a thin conical shell as in the previous embodiments. The pressure drop across the single vane is less than the pressure drop across a plurality of vanes because of the smaller cross-sectional area of the single vane.

Figure 11:
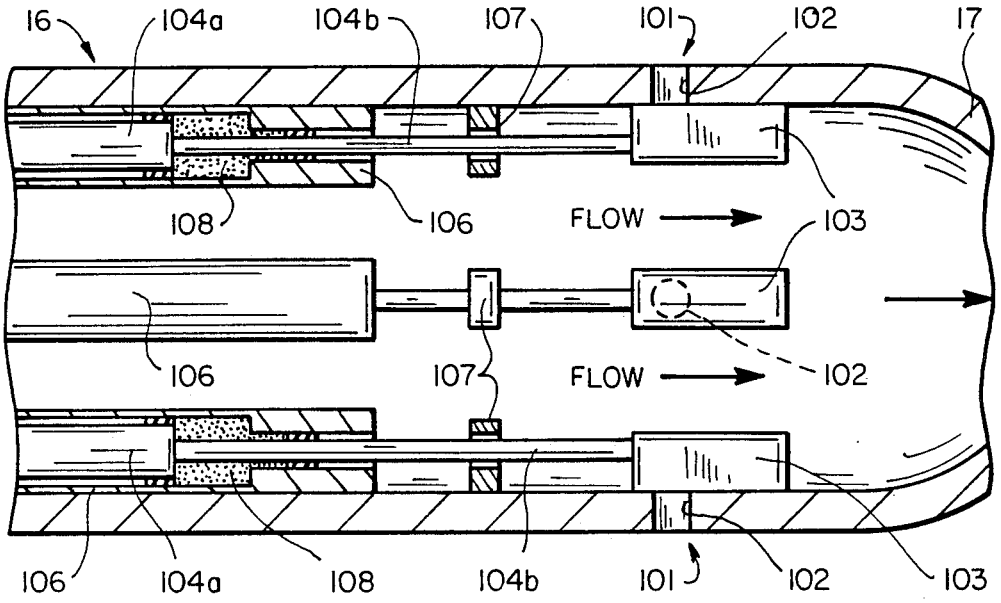
FIG. 11 is a centerline sectional view of another embodiment of drilling apparatus according to the invention.
Figure 12:
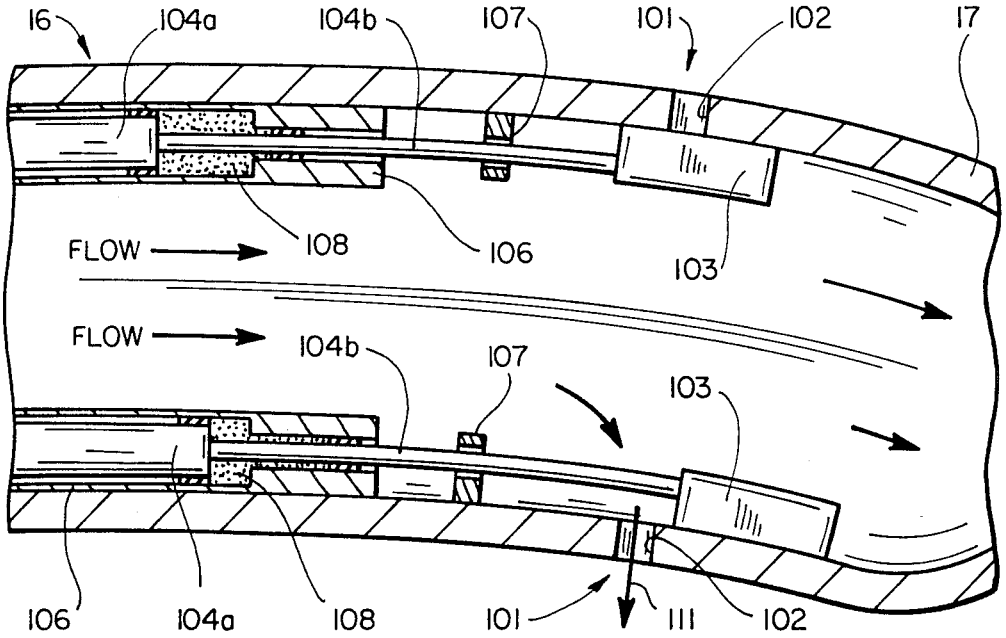
FIG. 12 is a centerline sectional view similar to FIG. 11, illustrating the operation of the apparatus.

In the embodiment of FIGS. 11–12, the distal end portion of the drill string 16 is provided with a closed loop control system for steering or guiding the drill head (not shown) as it advances into a formation. This system comprises side jets 101 spaced circumferentially about the string. The embodiment illustrated has four side jets spaced in quadrature, but any desired number of these jets can be employed. With a non-rotating string, at least three side jets are preferred, but with a rotating head, a single side jet can be employed if it is synchronized with the rotation of the string to provide the proper steering action. Each of the side jets comprises a discharge opening or orifice 102 which opens through the side wall of the string. These orifices are normally closed by sliding valve members 103 which can be moved between open and closed positions relative to the orifices. The valve members are connected to axially movable control rods 104 having proximal sections **104*a* mounted in retainer tubes 106 and distal sections 104*b* supported by guides 107. The retainer tubes are attached to the inner wall of the string along the entire length of one joint or section of the tube (typically about 10 feet), and the control rods are affixed to the retainer tubes at the proximal or upstream ends of sections 104*a*. Toward their distal ends, the control rods are free to slide within the retainer tubes and guides. Control rod sections 104*a* are of greater diameter and length than sections 104*b*, and the rod sections are coupled together by sealed hydraulic chambers 108 toward the distal ends of the retainer tubes. Each of these chambers has two bores of different diameters in which the confronting ends of rod sections 104***a*, 104*b* are received in piston-like fashion. Because of the difference in diameters, the hydraulic chamber provides an amplification in the movement of rod section 104b relative to section 104*a*.

Operation of the side jets is responsive to flexing or curvature of the drill string. When the string is straight, the control rods are in their rest positions, and orifices 102 are closed by valve members 103. When the drill string flexes, as illustrated in FIG. 12, the control rod on the outer side of the curve effectively shortens relative to the drill string, and the control rod on the inner side of the curve effectively lengthens. The orifice on the inside of the curve is thus opened, and a jet of fluid is discharged in a radial direction, as indicated by arrow 111. The reaction thrust of the radial jet tends to counteract the curvature of the drill string. The operation of this control system is not affected by rotation of the drill string.

The sensitivity of the control system increases directly with the diameter of the drill string and the length of the control rods. The use of hydraulic chambers to couple control rod sections of different diameters amplifies the motion of the valve members and further increases the sensitivity of the system.

Other types of control systems and sensors can be employed, if desired. For example, curvature of the drill string can be sensed by electrically operated sensors as disclosed in application Ser. No. 811,531, filed Dec. 19, 1985. The signals from these sensors can be used to control electrically operated valves to control the side jets. Likewise, electrically operated valves can be controlled by signals applied from the surface.

Figure 13:
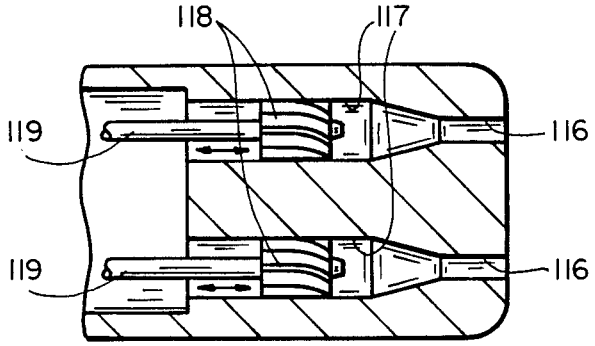
FIG. 13 is a fragmentary centerline sectional view of another embodiment of drilling apparatus according to the invention.

In the embodiment of FIG. 13, the drill head has four forwardly facing discharge nozzles 116 spaced about the axis of the drill head. Each of these nozzles is similar to nozzle 86 in the embodiment of FIGS. 8–9, and each of the nozzles is located at the distal end of a bore 117 in which a vaned flow director 118 similar to flow director 87 is mounted. Nozzles 116 can be inclined obliquely with respect to the axis of the drill head, or they can be parallel to the axis as illustrated in the drawings. Flow directors 118 are connected to actuators (not shown) by control rods 119 for movement between advanced and retracted positions within bores 117 to control the jets of drilling fluid delivered by the discharge nozzles. When the flow directors are advanced toward the nozzles, the jets are in the form of thin conical shells with relatively wide included angles, and when the flow directors are retracted, the jets are relatively narrow, pencil-like streams. The different types of jets cut differently shaped holes, and by controlling the jets on different sides of the axis, the geometry of the hole cut ahead of the drill string can be controlled. This determines the direction in which the hole is bored in the earth.

The jets can also be controlled by rotation of the flow directing vanes about the axes of the nozzles. If the vanes are allowed to rotate freely, the fluid mass will not rotate, and the resulting jet will be a narrow, pencil-like stream. In one embodiment using this method of control, the flow directors are rotated about their axes by the fluid flow, and braking forces are applied to selectively slow or stop the rotation of the individual flow directors and thereby control the shapes of the individual jets and the direction of drilling.

The drill head or the string on which the drill head is mounted can be provided with sensors such as gyroscopes for monitoring the orientation of the drill head and string. The signals produced by these sensors can be employed in controlling the positioning of the flow directors and, hence, the direction in which the hole is bored. One suitable gyroscope system is marketed by Ferranti Electric of Scotland under the trade name Pathfinder. This system utilizes three electrostatic gyroscopes and has an accuracy of one foot in 1,000 feet, in space.

Figure 14:
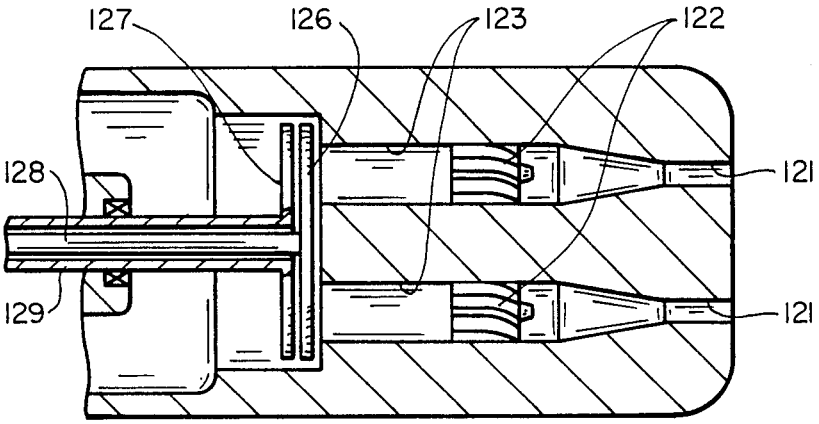
FIG. 14 is a fragmentary centerline sectional view of another embodiment of drilling apparatus according to the invention.

In the embodiment of FIG. 14, the drill head again has four forwardly facing nozzles 121 spaced from the axis of the head, with means for controlling the jets delivered by these nozzles to control the direction in which the hole is bored. In this embodiment, flow directors 122 are mounted in fixed positions in bores 123, and nozzles 121 deliver thin wall conical cutting jets when actuated. If desired, bores 123 and nozzles 121 can be inclined obliquely with respect to the axis of the drill head, or they can be parallel to it.

The drilling fluid which forms the jets delivered by nozzles 121 passes through a pair of relatively rotatable throttle plates 126, 127 at the inlet ends of bores 123. The throttle plates are mounted on concentric shafts 128, 129, and they are provided with apertures which can be aligned with each other and with selected ones of bores 123 to control the delivery of drilling fluid to the individual nozzles. In the embodiment illustrated, plate 126 has ten generally sector-shaped apertures 131 each having an arc length of 18° spaced symmetrically about the axis of the plate. Plate 127 has three apertures 132 with an arc length of 18°, two apertures 133 with an arc length of 36°, and one aperture 134 with an arc length of 126°. If apertures 132 are aligned with any three of the apertures 131, all of the apertures 131 will be open, and drilling fluid will be delivered equally to all four nozzles. If apertures 132 are not aligned with apertures 131, the nozzles on the side of the drilling head opposite apertures 132 will receive a greater amount of drilling fluid then the remaining nozzles, and the drill head will be steered accordingly.

Throttle plates 126, 127 are rotated by actuators (not shown) connected to shafts 128, 129. As in the embodiment of FIG. 13, the orientation and position of the drill head and string can be monitored by suitable sensors, and the rotation of the throttle plates can be controlled accordingly. Other types of throttling valves can be employed to accomplish the same result.

Figure 17:
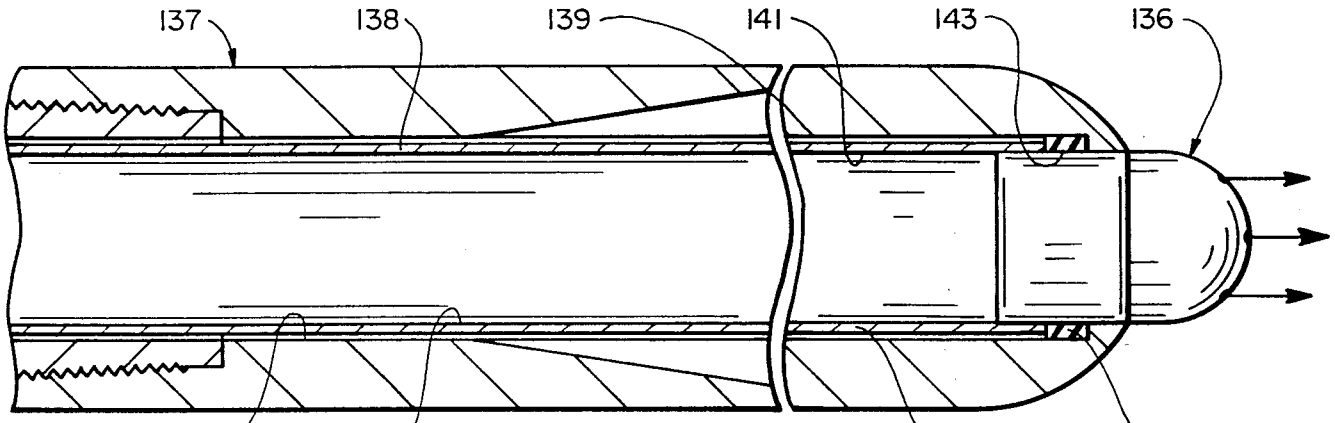
FIG. 17 is a centerline sectional view of another embodiment of drilling apparatus according to the invention.

In the embodiment illustrated in FIG. 17, the drill head 136 is removably mounted at the distal end of a tubular drill string 137 and can be withdrawn from the drill string and replaced without removing the drill string from the borehole. The drill head can, for example, be similar to drill head 18 or to the drill head illustrated in FIGS. 6–7. It is attached to the distal end of a relatively thin tubular liner or drill head carrier 138 which is inserted into the axial passageway 139 of the drill string. The drill head and the carrier are of slightly smaller diameter than the passageway of the string, and they can pass freely through this passageway. The carrier extends the length of the last section of the drill string (approximately 10 feet in one embodiment), and it has an axial passageway 141 which is open at its proximal end and thus in field communication with passageway 139. A seal 142 is mounted on the distal end of the carrier and can be removed with the carrier. This seal seats against a radial shoulder at the distal end of string 137 to provide a fluid-tight seal between the distal ends of the string and the carrier.

A releasable lock (not shown) is provided at the proximal end of the drill head carrier for securing the carrier to the string with the distal end of the carrier pressing against the seal and the drill head projecting beyond the distal end of the string. This lock can be similar to the breech lock of a gun, and it can be engaged and disengaged by rotation of about 90° with a tool (not shown) inserted into the string from the surface end of the borehole. If desired, a guidance system similar to that illustrated in FIGS. 11–12 can be mounted on the inner wall of drill head carrier 138 to steer the drill head.

In operation, the drill head and carrier are inserted into the drill string and secured in the position illustrated in FIG. 17. Pressurized drilling fluid is applied to the drill head through the passageways in the drill string and the carrier. To replace the drill head, the lock which secures the carrier to the string is disengaged by a tool passed through the string, and the drill head and carrier are then withdrawn from the string with this tool or another suitable tool. The drill head and carrier can be reinserted and reconnected to the string with the same tool or tools.

This embodiment is particularly suitable for use as a core cutter with the drill head 18 illustrated in FIGS. 1–5. As discussed above, the axially directed peripheral jets are not used for core cutting. The core sample is cut from the formation by the conical cutting jet, following which the drill head and carrier are removed from the string. A core removal tool is then inserted into the string, and the sample is withdrawn.

Figure 18:
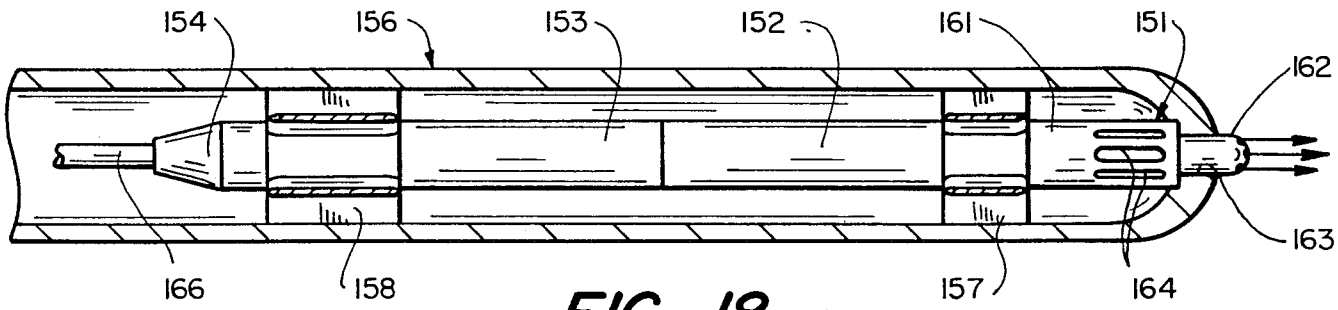
FIG. 18 is a centerline sectional view of another embodiment of drilling apparatus according to the invention with a modular pod construction.

FIG. 18 illustrates an embodiment of the drilling apparatus having a modular pod construction. This embodiment includes a nozzle module 151, a control pod 152, a gyro pod 153 and a tail cone 154. These elements are mounted in the distal end portion of drill string 156. The nozzle module, control pod, gyro pod and tail cone are threadedly connected together and supported coaxially within the string by spiders 157, 158 attached to the inner side wall of the string.

Figure 15:
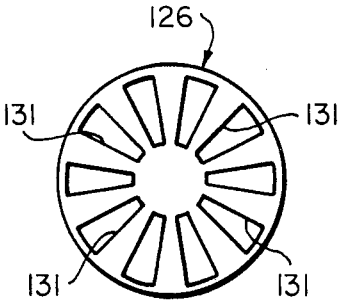
FIGS. 15 and 16 are plan views of throttle plates employed in the embodiment of FIG. 14.
Figure 16:
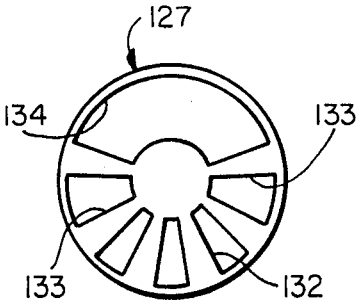

Nozzle module 151 comprises a cylindrical housing 161 with a drill head 162 projecting from the distal end of the housing. The drill head extends through an axial opening 163 in the distal end wall of the drill string. The drill head and the opening have matching tapers and O-rings or other seals (not shown) which facilitate seating and sealing of the drill head in the opening. Drill head 162 can be of the type illustrated in either FIG. 14 or FIG. 15, or it can be of any other suitable design. Inlet openings 164 are formed in the side wall of nozzle housing 161 to permit drilling fluid to pass from the string to the drill head.

The proximal end of nozzle module 151 is threadedly connected to the distal end of control pod 152. The control pod houses the actuators and control rods which control the delivery of drilling fluid jets by the nozzles in drill head 162.

The proximal end of control pod 152 is threadedly connected to the distal end of gyro pod 153. The gyro pod contains gyroscopes and associated electronics for determining the orientation of the string and drill head. The control pod also contains logic and control electronics.

Tail cone 154 is threadedly connected to the proximal end of gyro pod 153. The tail cone includes a connector for sucker rods and cabling (not shown) which extend between the tail cone and surface of the earth. In the embodiment illustrated, a relative thin tubular member 166 serves both as a sucker rod and as a conduit for the cable which carries electrical signals between the pod string and the surface of the earth. The tubular member can be formed in sections which are threadedly connected together, and a section of the tubular member can be added each time a section of drill string is added. The signals carried by the cable include outgoing gyroscopic and servo power data and returning positional data. Since the inertial guidance data from the gyroscopes is transmitted to the surface of the earth, a separate logging system is not required. Electrical power can be supplied to the pod string through the cable, or it can be provided by batteries mounted in the tail cone or in another section of the string.

Instead of being encased in a tubular member, the cables which carry the electric power and data signals can be embedded in a solid bar or rod which can also be utilized as a sucker rod. This rod can, for example, be fabricated of an electrically insulative material such as polyvinyl chloride or fiberglass, and the conductors can be embedded directly in the material. Conductors embedded in this manner are insulated from each other by the insulative material, and they are also isolated from the environment outside the rod. Sections of the rod with embedded conductors can be connected together as sections of the drill string are added, as can sections of a tubular member which encases the cables.

The modular construction makes the apparatus very flexible, and it permits additional pods to be employed, for example, an instrumentation pod for monitoring pressure and flow at the drill head or a pod for examination of the formation within the earth. The pod string can be removed and replaced through the drill string without withdrawing the entire drill string from the borehole. Lower spider 158 has a bayonet mount which permits the pod string to be readily installed and removed.

The guidance and control system described herein can provide both a real time indication of the drill string position to an operator and a real time capability to control or correct the course of drill string trajectory. The control system permits the trajectory of the drill string to be altered while the drill is stationary or rotating. The string can be steered up/down (pitch) and/or right/left (yaw) to guide the string toward a desired target.

The invention has a number of important features and advantages. It can be employed for drilling a number of different types of holes in the earth, including deep holes for oil and gas wells, horizontal holes, vertical (up or down) holes and slanted holes. It can be employed in both consolidated and unconsolidated formations with good cutting rates. It can be employed for cutting core samples as well as forming holes in these materials. The direction of the hole can be controlled automatically to eliminate undesired curvature or wandering of the borehole, and the drill head can be replaced or changed without removing the drill string from the borehole. The drill head has relatively few parts and is economical to manufacture.

It is apparent from the foregoing that a new and improved hydraulic drilling apparatus and method have been provided. While only certain presently preferred embodiments have been described in detail, as will be apparent to those familiar with the art, certain changes and modifications can be made without departing from the scope of the invention as defined by the following claims.

We claim:

1. In hydraulic drilling apparatus: a drill head having an internal chamber, means for producing a whirling mass of pressurized fluid in the chamber, and a discharge nozzle through which the pressurized fluid is discharged as a high velocity cutting jet in the form of a thin conical shell.

2. The drilling apparatus of claim 1 wherein the means for producing a whirling mass of pressurized fluid comprises a plurality of stationary inlet nozzles inclined obliquely about the chamber axis at one end of the chamber.

3. The drilling apparatus of claim 2 wherein the inlet jets are tapered conically.

4. The drilling apparatus of claim 1 wherein the discharge nozzle has an axially extending bore from which the drilling fluid is discharged.

5. The drilling apparatus of claim 4 wherein the bore of the discharge nozzle has a tapered portion which decreases in diameter toward its distal end.

6. The drilling apparatus of claim 4 including a plurality of axially directed nozzles spaced circumferentially about the discharge nozzle for delivering jets of high velocity fluid which intersect the conical shell of fluid from the discharge nozzle.

7. The drilling apparatus of claim 1 including a rotor driven about the axis by the pressurized fluid in the chamber and having an obliquely inclined bore which forms the discharge nozzle.

8. The drilling apparatus of claim 7 wherein the rotor has oppositely facing surfaces which interact with the pressurized fluid in the chamber to turn the rotor and limit the speed of rotation to about 5–50 rpm.

9. The drilling apparatus of claim 1 wherein the drill head is mounted on the distal end of a tubular drill string and in fluid communication with the interior of the drill string for receiving pressurized drilling fluid through the string.

10. The drilling apparatus of claim 1 wherein the means for producing a whirling mass of pressurized fluid comprises at least one flow directing vane for imparting a helical motion to the pressurized fluid within the discharge nozzle.

11. The drilling apparatus of claim 10 wherein a plurality of flow directing vanes are spaced circumferentially about the axis of the chamber and extend longitudinally within the chamber for imparting the helical motion to the fluid.

12. The drilling apparatus of claim 10 wherein the vane extends longitudinally of the chamber and has an inlet end portion generally parallel to the axis of the chamber and a distal end portion which extends obliquely to the axis of the chamber.

13. The drilling apparatus of claim 10 wherein the vane extends axially within the chamber and is twisted about the axis of the chamber.

14. The drilling apparatus of claim 10 including means for controlling the amount of fluid delivered to the flow directing vane to control the discharge of fluid from the nozzle.

15. The drilling apparatus of claim 1 including means for introducing an abrasive material into the pressurized fluid.

16. In a hydraulic drill head: a plenum chamber of circular cross-section, means for introducing a pressurized drilling fluid into the plenum chamber so that the fluid whirls rapidly about the axis of the chamber, an axially directed discharge nozzle which receives the whirling fluid from the plenum chamber and discharges a thin wall conical shell of the fluid, and a plurality of additional nozzles spaced circumferentially about the discharge nozzle in fluid communication with the plenum chamber for delivering high velocity jets of the fluid which intersect the conical shell of fluid from the discharge nozzle.

17. The drill head of claim 16 wherein the means for introducing the pressurized fluid into the plenum chamber comprises a plurality of stationary inlet nozzles inclined obliquely about the axis of the chamber.

18. The drill head of claim 17 wherein the inlet nozzles are conically tapered.

19. The drill head of claim 16 wherein the discharge nozzle has an axially extending bore which is conically tapered toward its proximal end and cylindrical toward its distal end.

20. The drill head of claim 16 wherein the drill head is mounted on the distal end of a tubular drill string and in fluid communication with the interior of the drill string for receiving pressurized drilling fluid through the string.

21. In a hydraulic drill head: means for providing a whirling mass of pressurized fluid, a rotor which is rotated about its axis by the pressurized fluid and has at least one longitudinally extending bore inclined obliquely to the axis for receiving the pressurized fluid and delivering a jet of fluid which sweeps about the axis in a circular manner as the rotor turns.

22. The drill head of claim 21 wherein the means for providing a whirling mass of pressurized fluid comprises a plurality of stationary inlet nozzles inclined obliquely about the axis of the rotor.

23. The drill head of claim 22 wherein the inlet nozzles are conically tapered.

24. The drill head of claim 21 wherein the rotor has a plurality of obliquely inclined bores each of which delivers a jet of fluid which sweeps about the axis as the rotor turns.

25. The drill head of claim 21 wherein the rotor has oppositely facing surfaces which interact with the fluid from the inlet nozzles to turn the rotor and limit the speed of rotation to about 5–50 rpm.

26. The drill head of claim 21 wherein the drill head is mounted on the distal end of a tubular drill string and in fluid communication with the interior of the drill string for receiving pressurized drilling fluid through the string.

27. In a method of drilling a borehole in the earth with a hydraulic drill head at the distal end of a tubular drill string to which a pressurized fluid is applied, the steps of: producing a whirling mass of the pressurized fluid, and introducing the whirling fluid into a discharge nozzle in such manner that the fluid spins helically within the nozzle and emerges therefrom as a high velocity cutting jet in the form of a thin conical shell for cutting into the earth.

28. The method of claim 27 wherein the whirling mass of pressurized fluid is produced by passing the pressurized fluid through a plurality of stationary inlet nozzles inclined obliquely about the axis of the drill head.

29. The method of claim 27 including the steps of discharging a plurality of axially directed jets of fluid from the drill head through nozzles spaced circumferentially of the discharge nozzle, said axially directed jets passing through the conical shell and impinging upon the earth within the region bounded by the conical shell.

30. The method of claim 27 including the steps of applying the whirling fluid to a rotor within the drill head to turn the rotor about the axis of the drill head, and discharging the fluid from the drill head through a bore in the rotor inclined obliquely to the axis of the rotor.

31. The method of claim 30 wherein the fluid is applied to oppositely facing surfaces on the rotor to limit rotation of the rotor to a speed on the order of 5–50 rpm.

32. The method of claim 27 wherein the whirling mass of pressurized fluid is produced by directing the fluid past at least one flow directing vane which imparts a circular motion to the fluid.

33. The method of claim 32 wherein the amount of fluid directed past the flow directing vane is controlled to control the jet which emerges from the discharge nozzle.

34. The method of claim 27 including the step of adding an abrasive material to the pressurized fluid applied to the drill stem.

35. In a method of drilling a borehole in the earth with a hydraulic drill head at the distal end of a tubular drill string to which a pressurized fluid is applied, the steps of: producing a whirling mass of the pressurized fluid, and introducing the whirling fluid into an axially extending discharge nozzle in such manner that the fluid spins helically within the nozzle and emerges therefrom as a thin wall conical shell of fluid for cutting into the earth.

36. The method of claim 35 wherein the whirling mass of pressurized fluid is produced by passing the pressurized fluid through a plurality of stationary inlet nozzles inclined obliquely about the axis of the drill head.

37. The method of claim 35 including the step of discharging a plurality of axially directed jets of fluid from the drill head through nozzles spaced circumferentially of the discharge nozzle, said axially directed jets passing through the conical shell and impinging upon the earth within the region bounded by the shell.

38. The method of claim 35 wherein the whirling mass of pressurized fluid is produced by directing the fluid past at least one flow directing vane which imparts a helical motion to the fluid.

39. The method of claim 35 including the step of adding an abrasive material to the pressurized fluid applied to the drill stem.

40. In a method of drilling a borehole in the earth with a hydraulic drill head at the distal end of a tubular drill string to which a pressurized fluid is applied, the steps of: producing a whirling mass of the pressurized fluid, applying the whirling fluid to a rotor within the drill head to turn the rotor about the axis of the drill head, and discharging the fluid from the drill head through a bore in the rotor inclined obliquely to the axis of rotation.

41. The method of claim 40 wherein the whirling mass of pressurized fluid is produced by passing the pressurized fluid through a plurality of stationary inlet nozzles inclined obliquely about the axis of the drill head.

42. The method of claim 40 wherein the fluid is applied to oppositely facing surfaces on the rotor to limit rotation of the rotor to a speed on the order of 5–50 rpm.

43. In a hydraulic drill head: an axially extending chamber having inlet and discharge ends, a plurality of radial vanes extending longitudinally of the chamber with inlet end portions generally parallel to the axis of the chamber and distal end portions oblique to the axis for causing pressurized fluid applied axially to the input end of the chamber to whirl rapidly about the axis at the distal end of the chamber, and a nozzle at the distal end of the chamber for receiving whirling fluid and discharging the fluid as a thin wall conical shell.

44. The drill head of claim 43 wherein the inlet end portions of the vanes are relatively straight and the distal end portions are curved in the direction of the whirling fluid.

45. The drill head of claim 43 wherein the inlet and distal end portions of the vanes are tapered.

46. The drill head of claim 43 including means for controlling the amount of pressurized fluid applied to the vanes to control the discharge of the fluid from the nozzle.

47. In a hydraulic drill head: an axially extending chamber having inlet and discharge ends, an axially extending vane mounted within the chamber and being twisted about the axis of the chamber for imparting a whirling motion to pressurized fluid passing between the inlet and discharge ends of the chamber, and a nozzle at the discharge end of the chamber for receiving the whirling fluid and discharging the fluid in a thin wall conical shell.

48. The drill head of claim 47 wherein the vane is mounted in a fixed position within the chamber.

49. The drill head of claim 47 including means for controlling the amount of fluid passing through the chamber to control the discharge of fluid from the nozzle.

50. In hydraulic drilling apparatus: a drill head having an internal chamber, a discharge nozzle through which pressurized fluid is discharged from the chamber, and at least one flow directing vane for imparting a helical motion to the pressurized fluid within the discharge nozzle, the flow directing vane being movable axially relative to the discharge nozzle to control the manner in which the fluid is discharged from the nozzle.

51. In hydraulic drilling apparatus: a drill head having an internal chamber, a discharge nozzle through which pressurized fluid is discharged from the chamber, and at least one flow directing vane for imparting a helical motion to the pressurized fluid within the discharge nozzle, the flow directing vane being adapted for rotation about the axis of the discharge nozzle to control the amount of helical motion imparted to the fluid.

52. In a method of drilling a borehole in the earth with a hydraulic drill head at the distal end of a tubular drill string to which a pressurized fluid is applied, the steps of: directing a pressurized fluid past at lease one flow directing vane to impart a circular motion to the fluid and thereby produce a whirling mass of pressurized fluid, introducing the whirling fluid into a discharge nozzle in such manner that the fluid spins helically within the nozzle and emerges therefrom as a jet for cutting into the earth, and moving the flow directing vane in an axial direction relative to the discharge nozzle to control the shape of the jet which emerges from the nozzle.

53. In a method of drilling a borehole in the earth with a hydraulic drill head at the distal end of a tubular drill string to which a pressurized fluid is applied, the steps of: directing a pressurized fluid past at lease one flow directing vane to impart a circular motion to the fluid and thereby produce a whirling mass of pressurized fluid, introducing the whirling fluid into a discharge nozzle in such manner that the fluid spins helically within the nozzle and emerges therefrom as a jet for cutting into the earth, and rotating the flow directing vane about the axis of the discharge at a controlled rate to control the circular motion imparted to the fluid.

54. In a hydraulic drill head: an axially extending chamber having inlet and discharge ends, a plurality of radial vanes extending longitudinally of the chamber with inlet end portions generally parallel to the axis of the chamber and distal end portions oblique to the axis for causing pressurized fluid applied axially to the input end of the chamber to whirl rapidly about the axis at the distal end of the chamber, and a nozzle at the distal end of the chamber for receiving whirling fluid and discharging the fluid as a thin wall conical shell, the radial vanes being movable between different axial positions relative to the nozzle for controlling the manner in which the fluid is discharged from the nozzle.

55. In a hydraulic drill head: an axially extending chamber having inlet and discharge ends, a plurality of radial vanes extending longitudinally of the chamber with inlet end portions generally parallel to the axis of the chamber and distal end portions oblique to the axis for causing pressurized fluid applied axially to the input end of the chamber to whirl rapidly about the axis at the distal end of the chamber, a nozzle at the distal end of the chamber for receiving whirling fluid and discharging the fluid as a thin wall conical shell, and means comprising a pair of relatively rotatable throttle plates having flow control apertures adapted to be selectively positioned in or out of registration with the nozzle for controlling the amount of pressurized fluid applied to the vanes and thereby controlling the discharge of the fluid from the nozzle.

56. In a hydraulic drill head: an axially extending chamber having inlet and discharge ends, a plurality of radial vanes extending longitudinally of and being rotatable about the axis of the chamber with inlet end portions generally parallel to the axis of the chamber and distal end portions oblique to the axis for causing pressurized fluid applied axially to the input end of the chamber to whirl rapidly about the axis at the distal end of the chamber, means for controlling the rate of rotation of the vanes to control the rate at which the fluid whirls about the axis, and a nozzle at the distal end of the chamber for receiving whirling fluid and discharging the fluid as a thin wall conical shell.

57. In a hydraulic drill head: an axially extending chamber having inlet and discharge ends, an axially extending vane mounted within the chamber and being twisted about the axis of the chamber with a rate of curvature which increases toward the distal end of the chamber for imparting a whirling motion to pressurized fluid passing between the inlet and discharge ends of the chamber, and a nozzle at the discharge end of the chamber for receiving the whirling fluid and discharging the fluid in a thin wall conical shell.

58. In a hydraulic drill head: an axially extending chamber having inlet and discharge ends, an axially extending vane mounted within the chamber and being twisted about the axis of the chamber for imparting a whirling motion to pressurized fluid passing between the inlet and discharge ends of the chamber, and a nozzle at the discharge end of the chamber for receiving the whirling fluid and discharging the fluid in a thin wall conical shell, the vane being axially movable relative to the nozzle to control the manner in which the fluid is discharged from the nozzle.

59. In a hydraulic drill head: an axially extending chamber having inlet and discharge ends, an axially extending vane mounted within the chamber and being twisted about the axis of the chamber for imparting a whirling motion to pressurized fluid passing between the inlet and discharge ends of the chamber, a nozzle at the discharge end of the chamber for receiving the whirling fluid and discharging the fluid in a thin wall conical shell, and a pair of relatively rotatable throttle plates positioned coaxially of the chamber and having flow control apertures adapted to be selectively positioned in or out of registration with each other for controlling the amount of fluid passing through the chamber and thereby the discharge of fluid from the nozzle.

60. In a hydraulic drill head: an axially extending chamber having inlet and discharge ends, an axially extending vane mounted within the chamber for rotation about the axis of the chamber and being twisted about the axis of the chamber for imparting a whirling motion to pressurized fluid passing between the inlet and discharge ends of the chamber, means for controlling the rate of rotation of the vane to control the whirling motion imparted to the fluid, and a nozzle at the discharge end of the chamber for receiving the whirling fluid and discharging the fluid in a thin wall conical shell.

* * * * *